United States Patent [19]

Ho

[11] Patent Number: 4,952,138

[45] Date of Patent: Aug. 28, 1990

[54] STRUCTURE OF HANDY TORCH

[76] Inventor: Aiex Ho, No. 17, Yung An Street, Hsin Tien City, Taiwan

[21] Appl. No.: 461,908

[22] Filed: Jan. 8, 1990

[51] Int. Cl.[5] ..... F23Q 7/12

[52] U.S. Cl. ..... 431/255; 431/344

[58] Field of Search ..... 431/255, 344

[56] References Cited

U.S. PATENT DOCUMENTS 4,526,532 7/1985 Nelson .
4,538,984 9/1985 Nakagawa .
4,597,732 7/1986 Yoshinaga .
4,643,671 2/1988 Yoshinaga ..... 431/255

*Primary Examiner*—Carroll B. Dority
*Attorney, Agent, or Firm*—Varndell Legal Group

[57] ABSTRACT

A self-igniting handy torch which comprises an ignition device, a combustion device, a fuel tank as well as a main control device, whereby the fuel tank switch control and the flow rate control of the fuel gas blown out of a nozzle from the fuel tank can be achieved through one-step operation by means of the main control device.

2 Claims, 2 Drawing Sheets

STRUCTURE OF HANDY TORCH

BACKGROUND OF THE INVENTION

This invention relates to a handy torch and more particularly to a self-igniting torch, in which the switch control and the gas flow rate control are synchronously operated through mono-step procedure.

Various types of handy torches are disclosed in U.S. Pat. Nos. 4,526,532; 4,538,984 and 4,597,732. These torches commonly include an ignition device and a combustion device to burn combustible gases through self-igniting operation. For example, the handy torch which is disclosed in U.S. Pat. No. 4,597,732 comprises a fuel tank and body capable of being gripped, a valve device, a combustion device and an ignition device, which are connected to the upper portion of the body. The said body is interiorly provided with a member for supplying liquefied gas fuel in its gaseous state to the valve device, which is provided with a member for controlling a flow rate of fuel and a needle valve for opening and closing a passage, and a flow rate of gas flowing into the combustion device can be adequately adjusted by an opening and closing degree of the needle valve and by the said control member.

One disadvantage of the torches such as those described above is the need for opening and closing a passage and for controlling a flow rate of fuel by two separate control members. Because of the use of two separate control members, it takes longer time to regulate a flow rate of fuel to an adequate level, and more fuel is wasted during regulating operation. Another disadvantage of the said torches is the short service life of the control members thereof. Because the control members are generally made of metal material and operated through revolving control, they commonly wear off within a short period of time in use, to further affect their accuracy and performance in flow rate control.

The main object of the present invention is to provide a self-igniting handy torch, in which the opening and closing of a fuel passage as well as the flow rate control of fuel are conveniently and synchronously operated through mono-step operation by means of a main control device.

DETAILED DESCRIPTION OF THE PREFERRED EMBODIMENT

Figure 1:
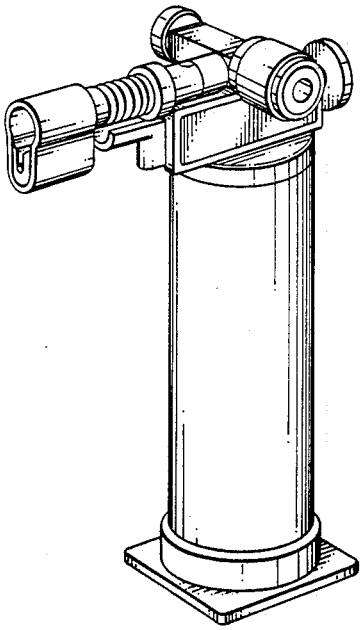
FIG. 1 is a perspective view of a handy torch according to the prior art.
Figure 2:
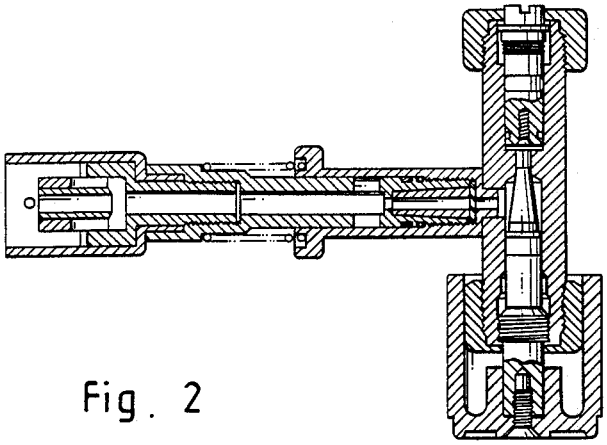
FIG. 2 is a sectional top view of the handy torch of FIG. 1.
Figure 3:
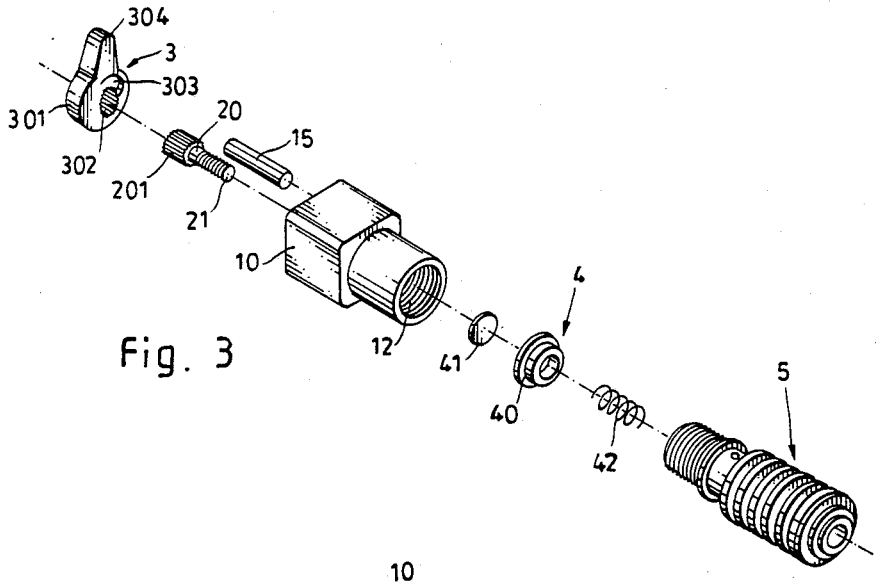
FIG. 3 is a perspective exploded view of the main control device of the present invention.
Figure 4:
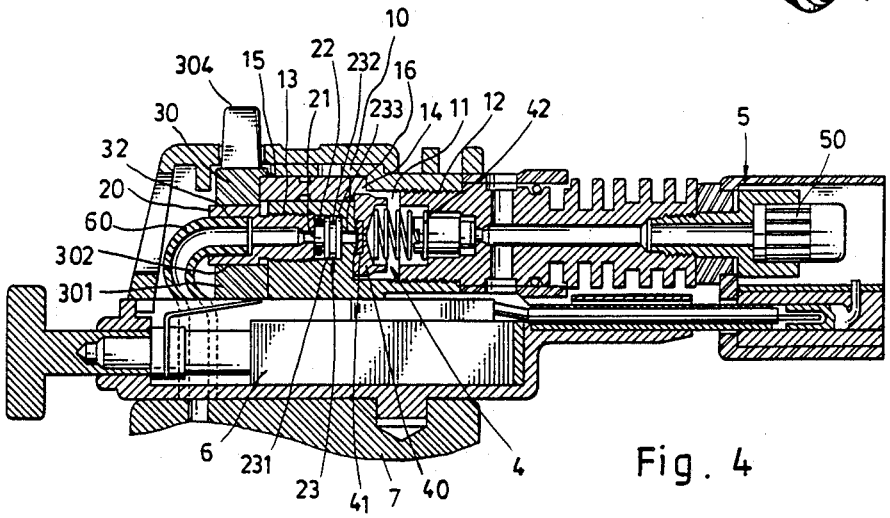
FIG. 4 is a sectional view of a handy torch constructed according to the present invention.

Referring to FIGS. 3 and 4, a handy torch in accordance with the present invention comprises an ignition device (6), a combustion device (5), a fuel tank (7), and a main control device, wherein the main control device is the scope of the improvement of the present invention.

The main control device includes a valve device (10) comprising a chamber (11) having a positioning hole (12), a bolt hole (13), and an orifice tube (16) between the chamber (11) and the bolt hole (13). A screw rod (20) which comprises a through-hole (21) and a toothed knob portion (201) is attached with an O-ring (22) and secured to the bolt hole (13) of the valve device (10) to push a washer assembly (23), which is comprised of a washer (231), a sponge (232) and a wire filter (233), so that its through-hole (21) can communicate with the orifice tube (16). A hole (32) is formed on the screw rod (20) opposite to and communicating with the through-hole (21). A gas pipe (60) is secured between the hole (32) and the fuel tank (7). A valve plug assembly (4) which is comprised of a valve disc (40) and a cushion (41) is set in the chamber (11) and pressed by a spring (42) to constantly block up the orifice tube (16). The valve disc (40) may be pushed by a valve rod (15) to define a clearance with the orifice tube (16) for gas flow rate control. The valve rod (15) is an elongated rod having an O-ring mounted thereon, and movably positioned in a sliding hole (14) which is made on the valve device (10) above the bolt hole (13) and communicating with the chamber (11). The combustion device (5) which includes a nozzle (50) is secured to the positioning hole (12) of the valve device (10) permitting the fuel gas from the gas tank (7) to blow out through the nozzle tip (50). A regulator device (30) which comprises a ring portion (301) which has a toothed boring bore (302) and a thumb portion (304) is mounted on the screw rod (20), with its toothed boring bore (302) engaged with the toothed knob portion (201) of the screw rod (20). A circular bevel recess (303) is made on the ring portion (301) at a position corresponding to the valve device (10), against which the valve rod (15) is stopped. Through the revolving of the regulator device (30), the valve rod (15) is forced by the circular bevel recess (303) to axially move forward or backward in the valve device (10). When the regulator device (30) is turned to its limit position, the valve rod (15) is stopped at the deepest point on the circular bevel recess (303), permitting the chamber (11) to communicate with the sliding hole (14), i.e. the valve rod (15) does not push the valve disc (40). Therefore, the valve rod (15) is simultaneously carried to move forward or backward for gas flow rate control when the circular bevel recess (303) is turned to rotate clockwise or counter-clockwise.

Figure 5:
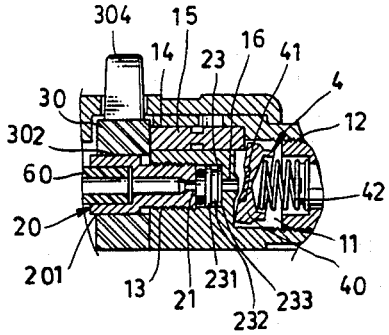
FIG. 5 is a sectional assembly view of the main control device of FIG. 3.

Referring to FIGS. 4 and 5, the cushion (41) and the valve disc (40) are forced by the spring (42) to block up the orifice tube (16). Therefore, no fuel gas comes out of the orifice tube (16) from the gas tank (7). When in use, the regulator device (30) is turned to rotate through a certain angle, to simultaneously drive the screw rods to screw outward so as to permit the gas to come from the gas tank (7) to the combustion device (5) through the orifice tube (16). During the rotation of the regulator device (30), the contact point of the regulator device (30) is changed with the valve rod (15). Because of the displacement of the circular bevel recess (303) relative to the valve rod (15), the valve rod (15) is forced to move in the valve device (10) and to push the cushion (41) and the valve disc (40) to move away from the orifice tube (16), while the screw rod (20) is also turned to gradually release from the washer assembly. Therefore, the gas flow rate is simultaneously regulated. When the regulator device (30) is turned back to original position, the screw rod (20) is turned to press on the washer assembly (23) to further reduce gas flow rate. At the same time, the valve rod (15) is forced by the circular bevel recess (303) to axially move forward to further push the cushion (41) and the valve disc (40) to block up the orifice tube (16).

What is claimed:

1. A handy torch comprising an ignition device, a combustion device, a fuel tank, and a main control device, wherein said main control device includes a valve device comprising a chamber having a positioning hole, a bolt hole, an orifice tube between said chamber and said bolt hole, a sliding hole above said bolt hole and communicating with said chamber; a screw rod being inserted in said bolt hole and having a toothed knob portion, and a through-hole communicating with said fuel tank via a gas pipe; a washer assembly pushed by said screw rod to permit the communication of said orifice tube with said gas pipe through said through-hole; a valve plug assembly comprised of a cushion and a valve disc and being constantly pressed by a spring to block up said orifice tube; a valve rod inserted in said sliding hole, said valve rod having its one end stopped against said valve plug assembly and its other end disposed in parallel with said screw rod; a regulator device comprising a thumb portion and a ring portion, said ring portion having a toothed boring bore connected with said toothed knob portion of said screw rod, a circular bevel recess on its side face cooperating with said valve rod, said circular bevel recess being turned to force said valve rod to axially move forward or backward so as to push said cushion and said valve disc to move apart from or block up said orifice tube to further regulate the gas flow rate coming from said fuel tank.

2. A handy torch according to claim 1, wherein said circular bevel recess is made on said ring portion of said regulator device and extends from zero depth to a depth equal to the length of the part of said valve rod which exposes outside or disposes inside said sliding hole, and equal to or slightly smaller than the distance between said sliding hole and a wall of said chamber.

* * * * *